US006918256B2

(12) United States Patent
Gutmark et al.

(10) Patent No.: US 6,918,256 B2
(45) Date of Patent: Jul. 19, 2005

(54) METHOD FOR THE REDUCTION OF COMBUSTION-DRIVEN OSCILLATIONS IN COMBUSTION SYSTEMS AND PREMIXING BURNER FOR CARRYING OUT THE METHOD

(75) Inventors: Ephraim Gutmark, Cincinnati, OH (US); Christian Oliver Paschereit, Baden (CH)

(73) Assignee: Alstom Technology LTD, Baden (CH)

( * ) Notice: Subject to any disclaimer, the term of this patent is extended or adjusted under 35 U.S.C. 154(b) by 0 days.

(21) Appl. No.: 10/358,312

(22) Filed: Feb. 5, 2003

(65) Prior Publication Data

US 2003/0150217 A1 Aug. 14, 2003

(30) Foreign Application Priority Data

Feb. 13, 2002 (DE) ..... 102 05 839

(51) Int. Cl.[7] ..... F23R 3/30
(52) U.S. Cl. ..... 60/737; 431/351
(58) Field of Search ..... 60/737–738; 431/350, 431/351–352, 354

(56) References Cited

U.S. PATENT DOCUMENTS 2,638,974 A 5/1953 Brierly
5,154,059 A * 10/1992 Keller ..... 60/737
5,487,274 A 1/1996 Gulati et al.
5,833,451 A 11/1998 McMillan

FOREIGN PATENT DOCUMENTS

| | | |
|---|---|---|
| DE | 3902601 C2 | 8/1990 |
| DE | 19545309 A1 | 6/1997 |
| DE | 19545310 A1 | 6/1997 |
| DE | 19917662 A1 | 11/2000 |
| EP | 0014221 A1 | 8/1980 |
| EP | 0321809 B1 | 5/1991 |
| WO | WO01/96785 | 12/2001 |

* cited by examiner

*Primary Examiner*—Louis J. Casaregola
(74) *Attorney, Agent, or Firm*—Burns, Doane, Swecker & Mathis, LLP

(57) ABSTRACT

A method and a device are described for the controlled damping of combustion-driven oscillations in a turbomachine with a burner system providing at least one burner, into which is introduced, via at least one burner nozzle arranged centrally in the burner, fuel which is intermixed with combustion inflow air flowing into the burner, to form a fuel/air mixture which is ignited in a combustion chamber following the burner system. The invention is distinguished in that the fuel nozzle is designed in the form of a burner lance, at the lance end of which fuel discharge into the burner takes place, and in that the burner lance projects into the burner in the amount of at least one third of the axial burner length.

9 Claims, 6 Drawing Sheets

METHOD FOR THE REDUCTION OF COMBUSTION-DRIVEN OSCILLATIONS IN COMBUSTION SYSTEMS AND PREMIXING BURNER FOR CARRYING OUT THE METHOD

This application claims priority under 35 U.S.C. §§ 119 and/or 365 to Appln. No. 102 05 839.3 filed in Germany on Feb. 13, 2002; the entire content of which is hereby incorporated by reference.

FIELD OF THE INVENTION

The invention relates to a method for the reduction of combustion-driven oscillations in combustion systems, in particular in those with low acoustic damping, such as are often to be found in combustion chambers of turbomachines, and to a premixing burner for carrying out the method.

BACKGROUND OF THE INVENTION

When turbomachines such as, for example, gas turbine plants are in operation, combustion-driven thermoacoustic oscillations often occur in the combustion chambers, these taking the form of fluidic instability waves at the burner and lead to flow vortices which greatly influence the entire combustion operation and lead to undesirable periodic heat releases within the combustion chamber. This results in pressure fluctuations of high amplitude which may lead to undesirable effects, such as to a high mechanical load on the combustion chamber housing, to increased $NO_x$ emission as a result of inhomogeneous combustion or even to an extinguishing of the flame within the combustion chamber.

Thermoacoustic oscillations are based at least partially on flow instabilities in the burner flow which are manifested in coherent flow structures and which influence the mixing operations between air and fuel.

A series of techniques have become known in the meantime for counteracting thermoacoustic oscillations, for example with the aid of a cooling-air film which is conducted over the combustion chamber walls or by means of an acoustic coupling of what are known as Helmholtz dampers in the region of the combustion chamber or in the region of the cooling-air supply.

It is known, furthermore, that the combustion instabilities occurring in the burner can be counteracted by the fuel flame being stabilized by the additional injection of fuel. Such an injection of additional fuel takes place via the head stage of the burner, in which a nozzle lying on the burner axis is provided for the pilot fuel gas supply, although this leads to an enrichment of the central flame stabilization zone. However, this method of reducing thermoacoustic oscillation amplitudes entails the disadvantage that the injection of fuel at the head stage is accompanied by an increase in the emission of $NO_x$.

Investigations of the formation of thermoacoustic oscillations have shown that flow instabilities often lead to these instabilities. Particular importance is attributed, in this case, to the shear layers which form between two mixing flows and which initiate waves running perpendicularly to the flow direction (Kevin-Helmholtz waves). These instabilities on shear layers, in combination with the combustion process which is taking place, are mainly responsible for the thermoacoustic oscillations triggered by reaction rate fluctuations. Where a burner of the abovementioned type is concerned, these largely coherent waves lead, under typical operating conditions, to oscillations with frequencies in the range around 100 Hz. Since this frequency coincides with typical fundamental characteristic modes of many annular burners in gas turbine plants, the thermoacoustic oscillations present a problem. More detailed statements in this respect may be gathered from the following publications: Oster & Wygnanski 1982, "The forced mixing layer between parallel streams", Journal of Fluid mechanics, Vol. 123, 91–130; Paschereit et al. 1995, "Experimental investigation of subharmonic resonance in an axisymmetric jet", Journal of Fluid Mechanics, Vol. 283, 365–407; Paschereit et al., 1998, "Structure and Control of Thermoacoustic Instabilities in a Gas-turbine Burner", Combustion, Science & Technology, Vol. 138, 213–232).

As may be gathered from the foregoing publications, it is possible to influence the coherent structures forming within the shear layers by the specific introduction of acoustic excitation in such a way that the formation of such vortices is largely prevented. Fluctuations in the heat release are consequently forestalled and the pressure fluctuations reduced.

Premixed flames require zones of low velocity, in order to become stabilized. For stabilizing the flame, there are backflow zones which are generated either by the wake downstream of disturbance bodies or by aerodynamic methods (vortex breakdown). The stability of the backflow zone is a further criterion for the stability of combustion and for the avoidance of thermoacoustic instabilities.

SUMMARY OF THE INVENTION

The object on which the invention is based is to provide a method for the reduction of combustion-driven thermoacoustic oscillations in combustion systems, in particular in those with low acoustic damping, which largely prevents the formation of coherent flow instabilities at the burner outlet, and to provide a premixing burner for carry ing out the method, which can be produced at a low outlay in terms of apparatus.

The object is achieved, according to the invention, by means of a method and a premixing burner of the type mentioned in the independent claims. Features advantageously developing the idea of the invention are the subject matter of the dependent claims and of the following description.

Proceeding from a combustion system which comprises, for example, a premixing burner of the type protected under EP 0 321 809 B1, the fundamental idea of the invention is to stabilize the central backflow zone which forms downstream of the burner outlet and within which the fuel/air mixture is ignited. By the stabilization of the backflow zone and the reduction in the formation of coherent vortex structures at the burner outlet, the periodic heat releases within the combustion chamber which caused the occurrence of thermoacoustic oscillations are largely forestalled.

The fluidic stabilization of the backflow zone takes place, according to the invention, in that the central fuel nozzle is provided in the form of a burner lance, such as is used conventionally for the pilot gas supply, the burner lance having a length which projects downstream into the burner from the burner head at least in the amount of one third of the axial burner length. Preferably, the burner lance has a length of 60–80% of the axial extent of the burner and is arranged centrally to the burner axis.

Advantageously, the fuel discharge takes place through at least one fuel nozzle orifice formed at the lance end, in such a way that the fuel discharged in the interior of the burner is mixed in a very finely distributed manner with inflow air and is at the same time swirled. In particular, due to the wake at the lance end, further stabilization of the aerodynamically generated backflow zone takes place. In particular, as a result of the fuel introduction according to the invention in a position shifted downstream within the burner interior, the flame forming within the backflow zone is prevented from periodically running out of the burner and running back into the latter. By the fuel discharge being in spatial proximity to the backflow zone forming within the combustion chamber, precisely that vortex breakdown can be assisted by the swirled fuel/air mixture spreading out in the flow direction, with the result that the backflow zone and consequently the flame are decisively stabilized.

It was recognized, furthermore, that the occurrence of coherent structures can be influenced by different lance forms. A series of preferred lance configurations will be presented in the following statements. These configurations have in common the fact that they additionally inhibit the occurrence of coherent structures by a fanning-out of the vortex movement.

In a further embodiment, the lance is equipped with means which make it possible to supply two fluid media independently of one another. Such a design also makes it possible, in addition to fuel injection, to introduce additional air into the burner interior. By the supply of this additional air being modulated in a way known per se, the combustion chamber oscillations can consequently be additionally counteracted.

In particular, when the premixing burner is operating with fuel being supplied via nozzles arranged along the casing into combustion air entering the burner interior tangentially, the measure according to the invention of partial fuel injection via the central fuel lance pushed into the interior contributes to the stabilization of the flame forming within the backflow zone.

BRIEF DESCRIPTION OF THE DRAWINGS

The invention will be described below by way of example, without the general idea of the invention being restricted, by means of exemplary embodiments, with reference to the drawings in which.

DETAILED DESCRIPTION OF THE INVENTION

Figure 1:
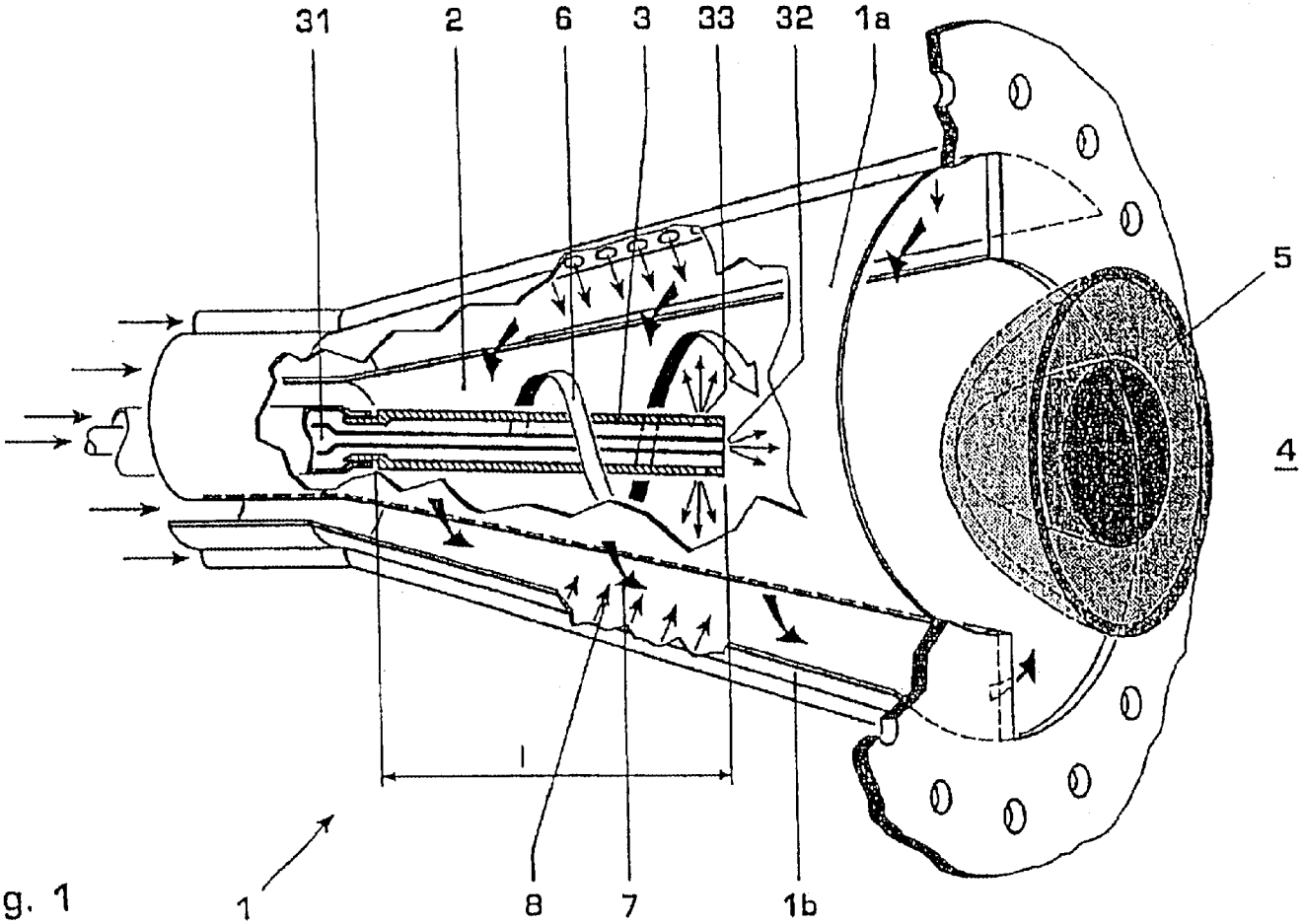
FIG. 1 shows a diagrammatic longitudinal section through a conically designed burner with a lengthened burner lance.

FIG. 1 illustrates in longitudinal section a premixing burner 1, such as may be gathered in terms of its basic construction, for example, from EP 0 321 809. The premixing burner 1 consists of two semimonocoque conically widening part bodies 1*a* and 1*b* which are arranged axially parallel, and offset to one another, in such a way that they form tangential gaps in two overlap regions located mirror-symmetrically opposite one another. The gaps resulting from the offset of the longitudinal axes of the part bodies 1*a* and 1*b* serve as inlet ducts, through which the combustion air 7 flows tangentially into the burner interior 2 when the burner is in operation. Located along these inlet ducts are injection orifices, through which a preferably gaseous fuel 8 is injected into the combustion air 7 flowing past. In addition to this fuel injection 8 at the burner casing, this abovementioned generic type of burner possesses, centrally arranged in the initial region of the burner interior 2, a nozzle for the introduction of further, preferably liquid fuel. Combustion air 7 and fuel 8, being intensively intermixed, pass through the burner interior 2, at the same time forming a swirl flow 6. At the burner outlet, the swirl flow 6 breaks down to form a backflow zone 5 with a stabilizing effect with respect to the flame front acting there. Further details of the construction and mode of operation of this burner 1 may be gathered from the abovementioned EP application and from other information sources known to a person skilled in the art.

According to the invention, a burner lance 3 projects parallel to the burner axis into the burner interior 2 in the prolongation of said central fuel nozzle. The lance 3, which has a length l preferably lying in the range of about ⅔ of the axial extent of the burner 1, has a centrally arranged fuel duct 31 which terminates downstream at the lance end in a fuel nozzle 32.

According to the design variant illustrated in FIG. 1, furthermore, the region of the lance end has issuing in it radiantly oriented nozzles 33, out which air is introduced into the burner interior 2 for the additional damping of thermoacoustic oscillations forming in the combustion system. Both this air and the fuel can be fed in in a modulated manner. The fuel/air mixture spreading out in swirl flow 6 through the burner interior 2 into the combustion chamber 4 can stabilize the backflow zone 5 forming within the combustion chamber 4, especially since the vortex intensity of the fuel/air mixture before and during ignition is conducive to the vortex breakdown within the combustion chamber 4, with the result that the backflow zone 5 is stabilized. The backflow zone 5 can thereby be prevented from changing its position periodically, this ultimately being the cause of the thermoacoustic oscillations propagated within the combustion system.

Figure 2:
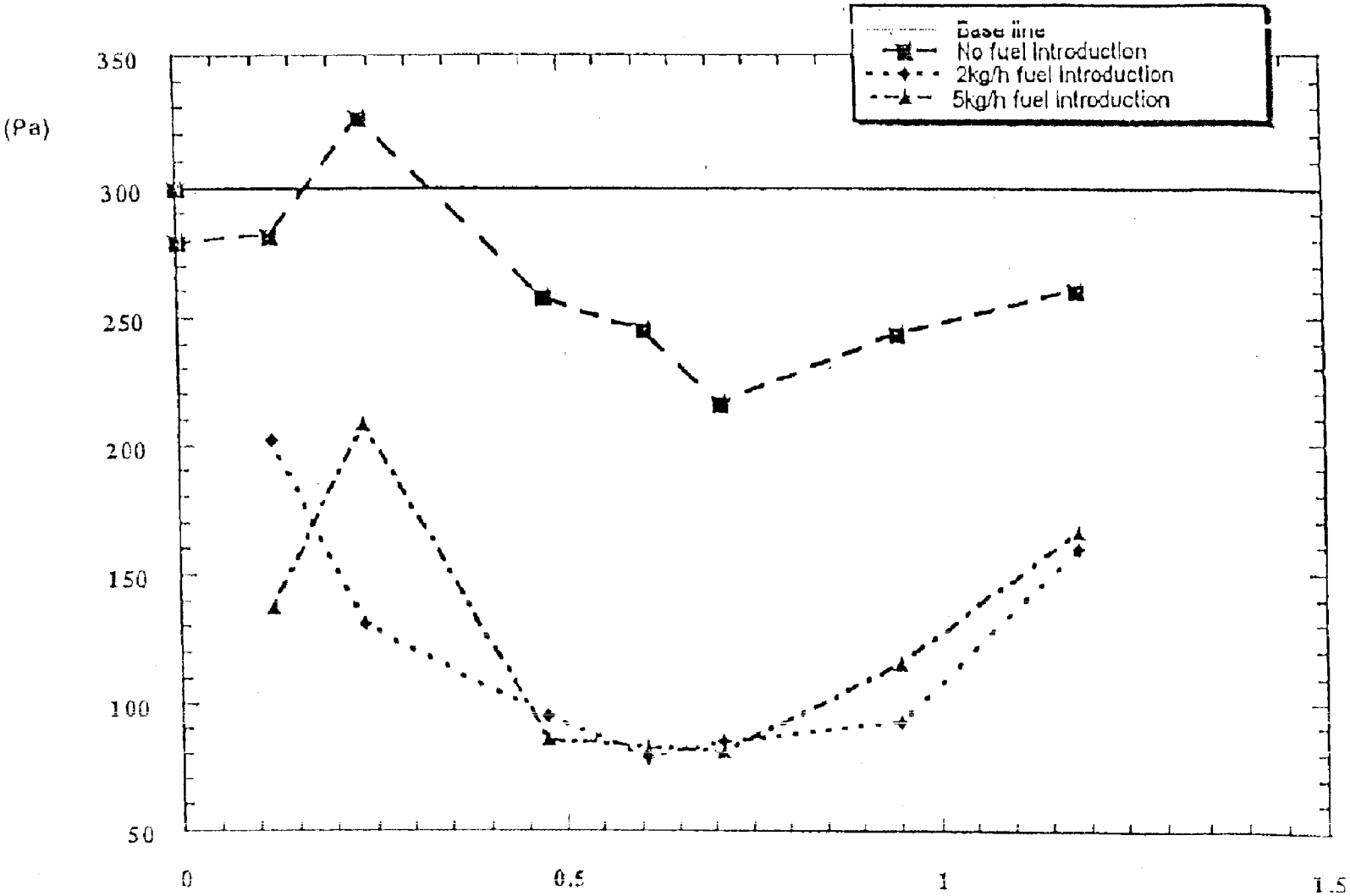
FIG. 2 shows a graphical illustration of the dependence of the length of the burner lance on the acoustic damping behavior.

FIG. 2 shows a graphical illustration which makes clear the action of the burner lance 3 designed according to the invention on the suppression of instabilities in the form of pressure oscillation in the 120 Hz range. The pulsations, which are plotted in pressure values (Pa) along the ordinate in FIG. 2, are plotted as a function of the position of the lance end in the burner 1. The ratio 1/L, that is to say the ratio of the length of the burner lance 3 to the total axial extent L of the burner, is plotted along the abscissa. The position 1/L=0 corresponds in this case to the original position of the central fuel nozzle, as mentioned above.

The various function profiles illustrated in the graph correspond to the following measurement conditions, such as may be gathered, moreover, from the caption of FIG. 2:

The line depicted continuously and horizontally corresponds to the base line, according to which burner systems known per se oscillate under predetermined operating conditions without the precaution of the lance designed according to the invention. The function profile interspersed with squares reproduces the oscillation behavior of a burner in the premix mode, during which only the central burner lance is provided, which, however, does not bring about any introduction of fuel into the burner. The line interspersed with the filled-in diamonds reproduces operation, using a burner lance 3 designed according to the invention, during which 2 kg of fuel discharge per hour was selected as the fuel addition by the burner lance 3. Finally, the dotted line interspersed with triangles shows a situation where the burner lance 3 designed according to the invention is used, similar to that line interspersed with the diamonds, but with a fuel addition of 5 kg per hour.

It becomes clear from FIG. 2 that, in the burner illustrated in FIG. 1, the instabilities occurring in the premix mode can be suppressed most effectively by means of a lance position of 1/L=0.6–0.8. The preferred lance position is in this case at 1/L=0.7.

The suppression of the instabilities occurring when the burner is in operation, and which can be ensured essentially by improved flame stability and by the destruction of coherent structures, can be improved by the lance end being configured as a disturbance body 10, 11, 13, in order to introduce vortex intensity in the flow direction. In this connection, various disturbance body geometries, according to which the lance end is to be designed, may be gathered from FIGS. 5–8. The characteristic curves, illustrated in FIG. 3, for illustrating the mode of action in the suppression of instabilities may be obtained as a function of the disturbance body geometries illustrated in these figures. The graphical illustration illustrated in FIG. 3 can be compared with that in FIG. 2. The affiliation of the individual function profiles to the differently designed disturbance body geometries may likewise be gathered directly from the caption of the figure. It again emerges that a suppression of instabilities is most markedly pronounced with a burner lance length of 1/L=0.6–0.8.

Figure 3:
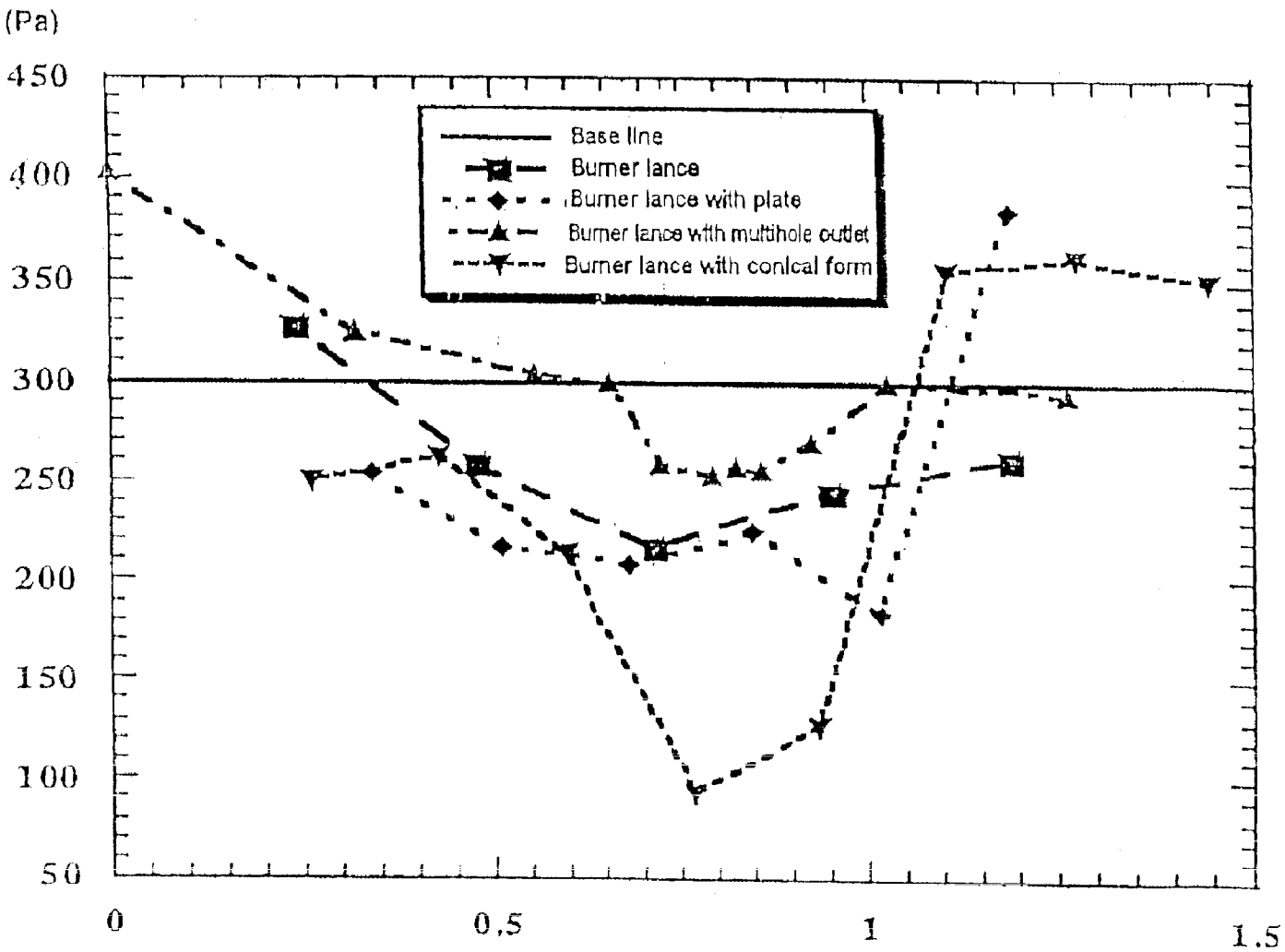
FIG. 3 shows a graphical illustration of the dependence of the length of the burner lance on the acoustic damping behavior in terms of different lance configurations.

Of all the disturbance geometries investigated, the conically designed burner lance (FIG. 7) proves particularly suitable for suppressing instabilities (see, in this respect, the broken line in FIG. 3 interspersed with upside-down triangles).

Figure 4:
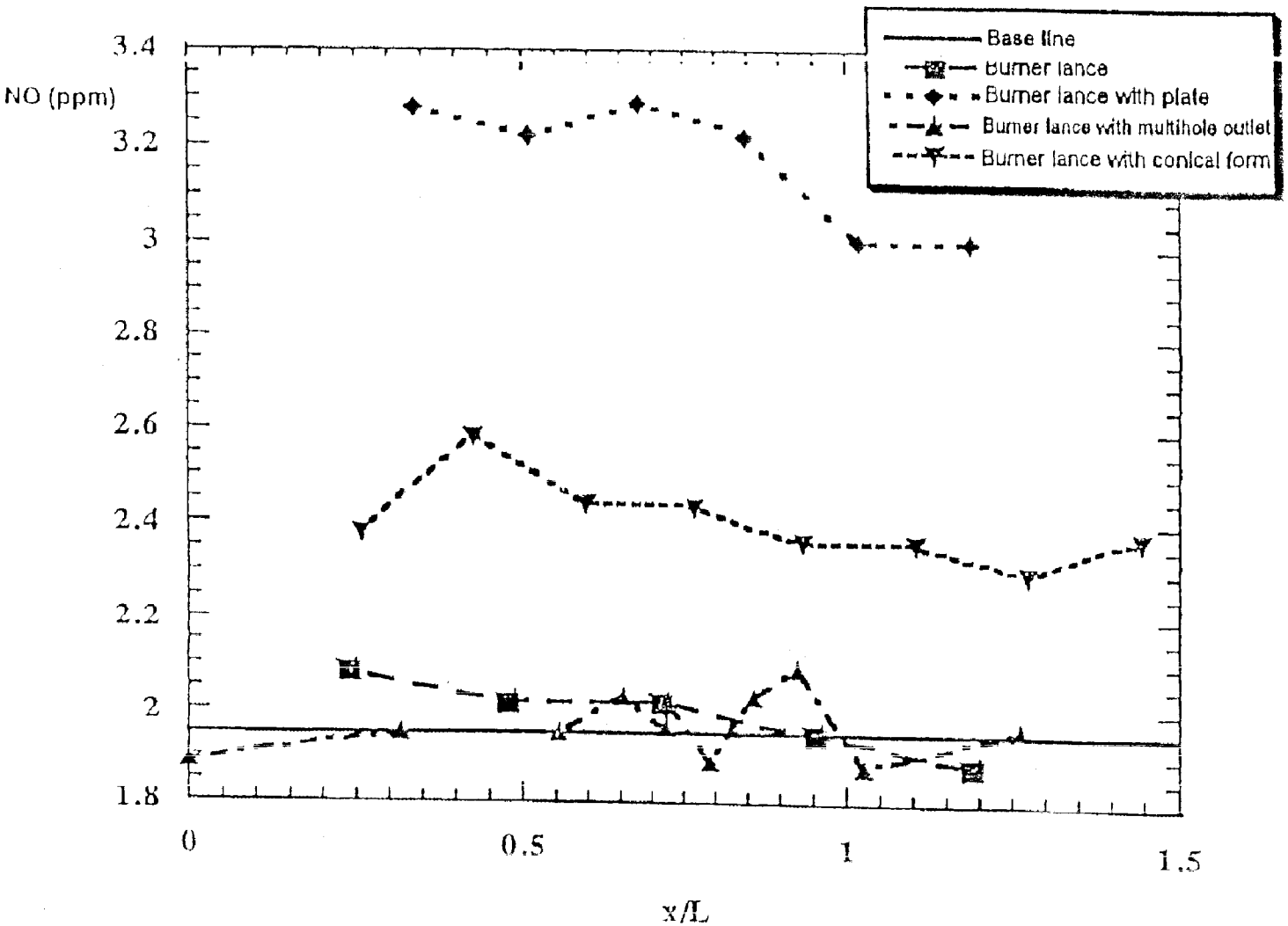
FIG. 4 shows a graphical illustration of the dependence of the length of the burner lance on the $NO_x$ emissions in terms of different lance configurations.

FIG. 4 illustrates the evaluation of the individual disturbance geometries in terms of nitrogen oxide emission. In this case, the burner lance interspersed with a multiplicity of fuel outlet orifices proves particularly advantageous, this being illustrated in FIG. 5. The disturbance geometry shown in FIG. 5 and the geometries shown in the following figures may be designed, for example, as threaded screw attachments which are screwed into the burner head and can easily be exchanged, in particular for test purposes.

Figure 5:
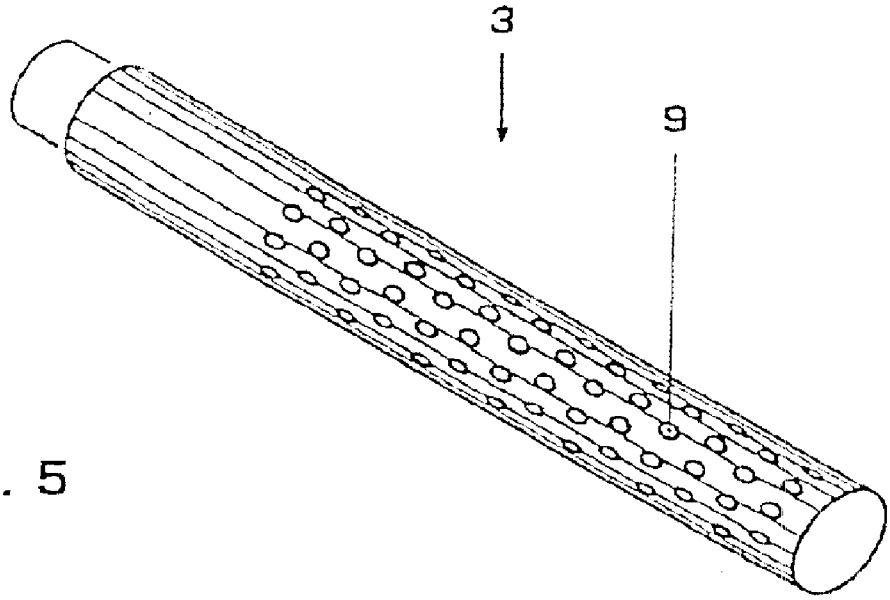
FIGS. 5–8 show different burner lance configurations.

The burner lance 3 shown in FIG. 5 is equipped with a multiplicity of fuel outlet orifices 9 passing laterally through the casing. A homogeneous intermixing of fuel and combustion air is ensured by an axial fanning-out of the fuel injection. Injection in this case takes place preferably in the region of the second lance half, as seen in the flow direction.

Figure 6:
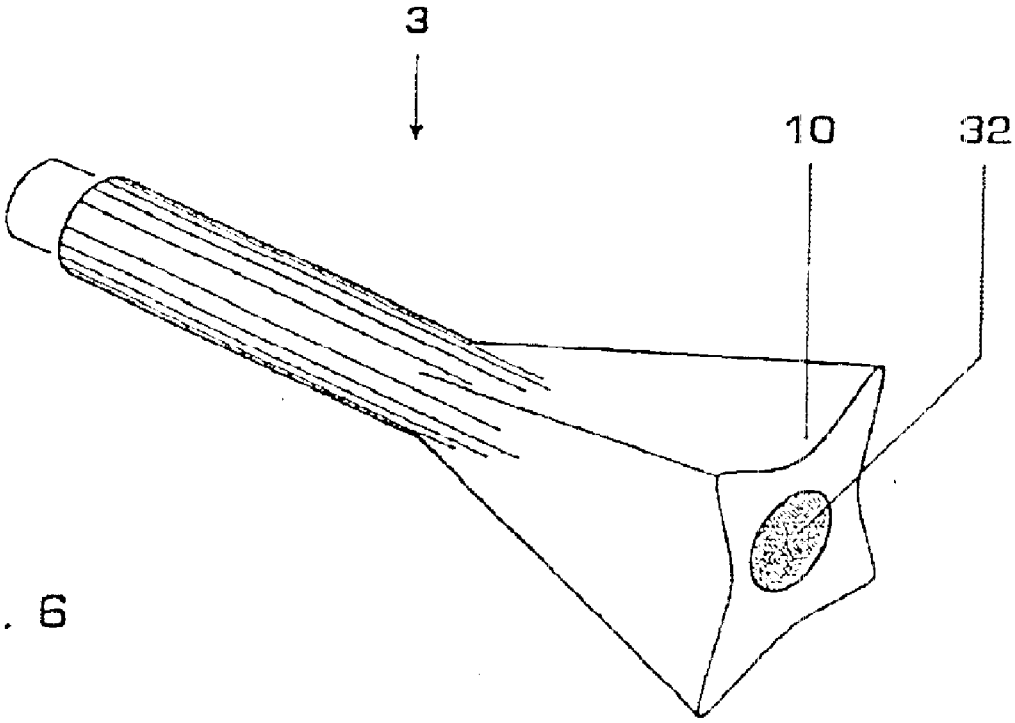
Figure 7:
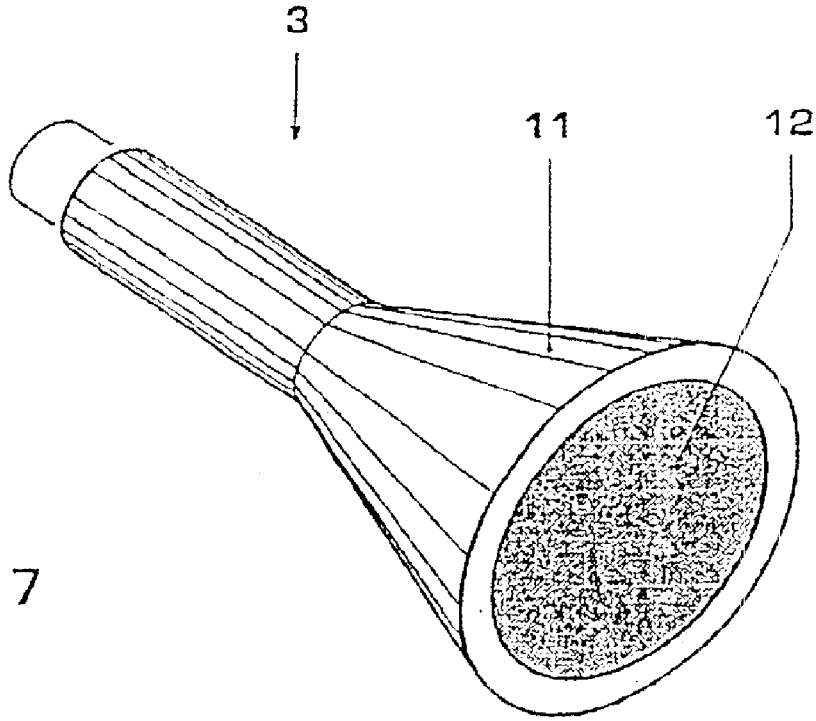
Figure 8:
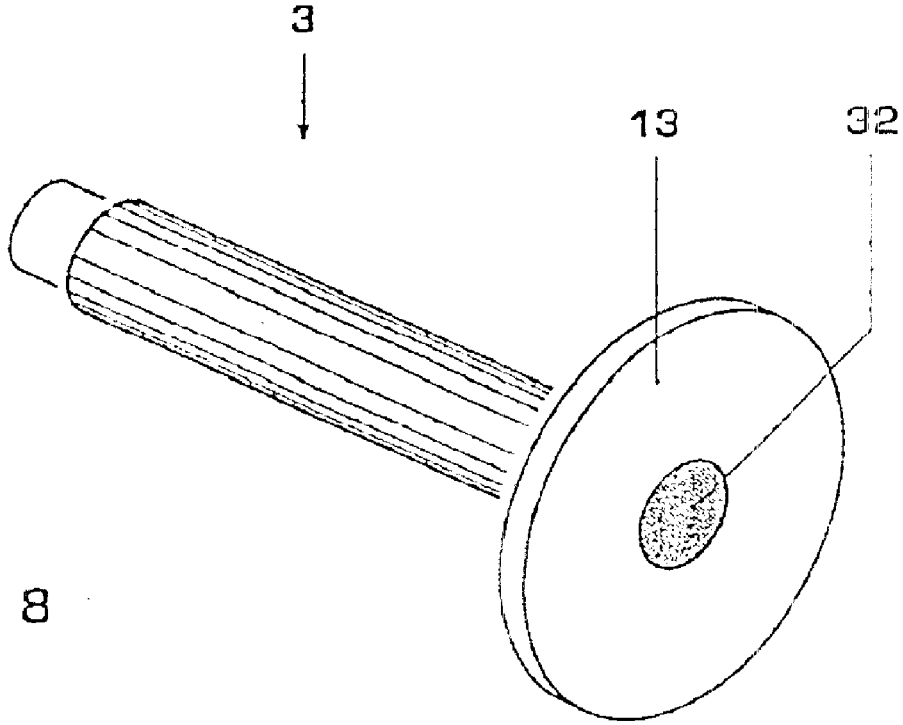

FIG. 6 shows a star-shaped lance end geometry, and FIG. 7 shows a conically designed lance end geometry, fuel discharge from the lance 3 taking place through axially oriented outlet orifices 12, 32, in a similar way to the lance geometry in FIG. 8 which shows a burner lance to which a plate 3 is attached.

As outlined above with reference to FIG. 3, the disturbance geometries can decisively influence the premix flow.

LIST OF REFERENCE SYMBOLS

1 Burner
1*a*; 1*b* Semimonocoques
2 Burner interior
3 Burner lance
31 Fuel line
32 Axial fuel outlet orifice at the lance 3
33 Radial air injection
4 Combustion chamber
5 Backflow zone
6 Swirl flow
7 Combustion air
8 Fuel
9 Fuel outlet orifice at the lance 3
10 Star-shaped lance end geometry
11 Conical lance end geometry
12 Fuel outlet orifice at the lance 3
13 Plate at the lance end
L Length of the burner lance

What is claimed is:

1. A premixing burner for the reduction of combustion-driven oscillations within a combustion system, in particular a combustion chamber of a turbomachine, essentially comprising a swirl generator consisting of two semimonocoque conically widening part bodies which are arranged axially parallel, and offset to one another, in such a way that they form tangential gaps in two overlap regions located mirror-symmetrically opposite one another, said gaps serving as inlet ducts for the combustion air into the burner interior, furthermore comprising at least one central fuel nozzle within the interior enclosed by the part bodies, wherein the central fuel nozzle is designed in the form of a coaxially oriented burner lance and projects into the burner interior up to at least one third of the axial length of the latter, and the burner lance is equipped, at least in its downstream end region, with means for the discharge of at least one fluid into the burner interior;

wherein the burner lance terminates in a range of between 60% and 80% of the axial length of the burner interior.

2. The premixing burner as claimed in claim 1, wherein the lance is designed essentially cylindrically.

3. The premixing burner as claimed in claim 1, wherein the lance has a widening cross section at least in its downstream end region.

4. The premixing burner as claimed in claim 3, wherein the lance has an end region widening conically in the flow direction.

5. The premixing burner as claimed in claim 3, wherein the lance has an end region widening in a star-shaped manner in the flow direction.

6. The premixing burner as claimed in claim 3, wherein the lance has in its end region a plate oriented perpendicularly to the flow direction.

7. The premixing burner as claimed in claim 1, wherein the end region of the burner lance is equipped with fuel outlet orifices.

8. The premixing burner as claimed in claim 1, wherein the end region of the burner lance is equipped with outlet orifices for fuel and combustion air.

9. The premixing burner as claimed in claim 1, wherein the casing of the burner lance is equipped with outlet orifices for fuel.

* * * * *